US005939688A

United States Patent [19]

Hutchinson

[11] Patent Number: 5,939,688

[45] Date of Patent: Aug. 17, 1999

[54] FLUID RESPONSIVE SWITCH PIVOT ARM SEAL

[75] Inventor: Harold D. Hutchinson, Oxnard, Calif.

[73] Assignee: Harwil Corporation, Oxnard, Calif.

[21] Appl. No.: 08/909,358

[22] Filed: Aug. 11, 1997

Related U.S. Application Data

[63] Continuation-in-part of application No. 08/630,011, Apr. 4, 1996, abandoned.

[51] Int. Cl.[6] ..... H01H 35/40

[52] U.S. Cl. ..... 200/81.9 R; 73/861.76; 29/622; 277/318; 200/302.3

[58] Field of Search ..... 200/81.9 RM, 200/84 R, 302.1, 302.3; 340/610, 625; 73/317, 861.74, 861.75, 861.76; 29/622; 277/432, 626, 634, 317, 318, 320, 321, 918, 641, 642

[56] References Cited

U.S. PATENT DOCUMENTS

| | | |
|---|---|---|
| 3,501,605 | 3/1970 | Hutchinson . |
| 3,845,259 | 10/1974 | Spurr . |
| 3,898,397 | 8/1975 | Devore . |
| 4,074,097 | 2/1978 | Hutchinson . |
| 4,109,126 | 8/1978 | Halbeck . |
| 4,454,398 | 6/1984 | Aschenbach . |
| 4,725,700 | 2/1988 | Zoludow . |

FOREIGN PATENT DOCUMENTS 2098399 11/1982 United Kingdom ..... 200/81.9 R

*Primary Examiner*—Gerald Tolin
*Attorney, Agent, or Firm*—David O'Reilly

[57] ABSTRACT

A fluid responsive switch having a pivot arm for monitoring fluid flowing in a conduit or the level of liquid in a container with an improved resilient seal. The pivot arm, in the fluid responsive switch, is mounted in a housing by a pivot pin and a resilient elastomer seal molded around the pivot arm and the pivot pin. To improve the bond of the resilient seal, the surface of the pivot arm is cross-cut to provide a plurality of grooves diagonal to the axis of the pivot arm. A further improvement to the seal is provided by circumferential annular grooves in the pivot arm at each end of the cross-cut surface. The circumferential annular grooves act as retention stops to retain the resilient material in the groove and resist shear stresses and peeling tension and increase the contact surface area of the metal to resilient elastomer bond. The circumferential annular grooves are cut in the surface of the pivot arm at each end of the cross-cut surface to improve the metal to elastomer material bond. An optional, but preferred feature of the invention is to provide a peripheral ridge molded around an upper surface of the seal to provide an O-ring type seal in an annular groove in a mounting plate. The molded peripheral ridge acts as an integrally formed dynamic O-ring seal.

8 Claims, 4 Drawing Sheets

FLUID RESPONSIVE SWITCH PIVOT ARM SEAL

This Application is a Continuation-In-Part of application Ser. No. 08/630,011 filed Apr. 4, 1996 and now abandoned.

BACKGROUND OF THE INVENTION

1. Field of the Invention

This invention relates to fluid responsive switches such as flow switches and liquid level switches; and more particularly, relates to a metal to elastomer seal for a pivot arm used in a fluid responsive switch.

2. Background Information

Fluid responsive switches are generally used in fluid flow conduits to monitor and control the rate of flow or in containers, to monitor liquid levels. These devices include a housing, having a connecting body mounted on a nipple on the fluid conduit. The fluid responsive switch includes a pivot arm having one end positioned to respond to the flow of fluid in a conduit or the liquid level in a container. The other end of the pivot arm extends into the flow switch housing. The pivot arm is pivotally mounted in the fluid responsive switch body by a pivot pin and a elastomer seal that allows the arm to pivot according to the force applied by the fluid flowing in a fluid conduit or the liquid level in a container. The pivot arm is constructed to operate a microswitch in response to the fluid flow or liquid level.

The elastomer seal around the pivot arm, where it is mounted in the connecting body of the fluid responsive switch, has to be sufficiently resilient to allow the pivot arm to easily pivot while at the same time, maintain a fluid tight seal. Various designs have been developed to provide this function. For example, U.S. Pat. No. 4,074,097 discloses the use of a rolling diaphragm held in place by a clamping plate in a recess of the mounting body of a flow switch. The periphery of the rolling diaphragm is sealed by the clamping plate in the recess in the mounting body. The arm may easily pivot with very little resistance by the rolling diaphragm and yet the necessary fluid tight seal is maintained.

This design has been improved by the use of a molded resilient seal around the pivot arm and the pivot pin for mounting the pivot arm. This design employs an elastomer to metal bond to separate the fluid flowing in the conduit from the housing of the fluid responsive switch. However, bonding the elastomer to the metal surface of the pivot arm has been a difficult process to perform reliably since it involves a multitude of operations such as surface preparation, primer selection, primer application, primer baking, elastomer molding operation, etc. Each operation requires a specific temperature, pressure and time cycles. It is not uncommon to produce the same molded seal on the pivot arm using the same molding materials and processes, and yet suddenly start having a large, unacceptable rejection rate. The metal to rubber interface is almost always the source of the problem.

Many methods have been tried to produce a reliable metal to rubber seal on the pivot arm. These methods involve parameter adjustments that includes roughening the metal surface (i.e., sanding, filing and sandblasting). Roughening the surface is an old trick that is sufficient for use on the post of a toggle switch such as that shown in U.S. Pat. No. 3,898,397 or on the terminals mounted in an electrical housing such as that shown in U.S. Pat. No. 4,454,398. However, this method is not entirely satisfactory for a seal around a shaft subject to movement and is in contact with a corrosive fluid flowing through a conduit. A more dynamic, durable seal is needed in such environments. A solution to the problem of bonding an elastomer or rubber to the metal surface of a movable pivot arm in a corrosive environment would be advantageous.

BRIEF DESCRIPTION OF THE INVENTION

The purpose of the present invention is to provide a fluid responsive switch having an improved molded elastomer seal on a pivot arm.

After extensive investigation and experimentation, a method of improving the integrity of the metal to elastomer, or rubber interface bond was discovered. The solution found was to provide a cross-cut surface, having a plurality of linear and/or cross-cut grooves to substantially increase the bonding area of the elastomer or rubber seal. The smooth metal surface of the pivot arm is difficult to bond to an elastomer because the area of the pivot arm, where the seal is furnished, provides a small bonding surface area. Further, the smooth cylindrical pivot arm presents maximum "peeling" tension stress and a maximum peeling angle of 180°. The use of a cross-cut surface, comprised of cross-cut diagonal grooves, presents substantially reduced peeling tension stress, and substantially reduced peeling angle (i.e., from 180° to 90° thus providing an order of magnitude increase in bonding strength and integrity. The addition of linear and/or cross-cut diagonal grooves in the surface also acts to break-up the bonding surface into a series of closely spaced "divots", reducing the maximum localized shear stress by an order of magnitude or more. This also reduces the localized tension load on the elastomer seal by spreading the load over several adjacent pathways. The multiplicity of cross-cut diagonal grooves also acts to increase the total rubber to metal bonding surface area by an order of magnitude or more thus, reducing the localized rubber to metal stress per unit surface area by an order of magnitude or more.

As a further improvement to the design, circumferential grooves were added at each end of the cross-cut surface. These circumferential grooves further increase the resistance to the peeling tension stress and peeling angle. The circumferential grooves reduce the peeling angle by 90°, changing the 180° peeling stresses to a 90° shear stress.

The cross-cut surface, where the elastomer seal is molded, is preferably around the pivot pin that pivotally mounts the pivot arm. The cross-cut surface extends an equal distance on either side of the pivot pin and covers the pivot arm where the elastomer seal is bonded. The molded elastomer seal covers a portion of the pivot pin, the cross-cut surface and flows into the circumferential grooves at each end of the cross-cut area. This design was found to provide a substantial improvement in seal integrity and minimize the number of parts rejected.

Another option is the addition of circumferential grooves between the circumferential grooves at each end of the cross-cut surface. The depth of the grooves should be sufficient to provide substantial resistance to peeling tension and peeling angle while avoiding any weakness in the pivot arm. A circumferential annular groove, having a depth of approximately twenty to forty thousandths of an inch and a width of forty thousandths of an inch, proved to be effective and preferable. The circumferential annular grooves act as rubber tension grooves to change peeling stresses to shear stress.

The cross-cut surface has cross-cut diagonal grooves of approximately ten to fifteen thousandths of an inch on a pivot arm, being approximately one-quarter of an inch in diameter. The combination and integration of cross-cut diagonal grooves creating a multiplicity of small islands and divots, and with the circumferential annular grooves provide a synergistic effect producing a major increase in elastomer to metal bond strength. The depth, width, shape and angle of the cross-cut grooves are adjusted according to the metal/elastomer surface interface loads. Optionally, additional intermediate circumferential annular grooves or rubber retention stops can be provided if desired.

The above and other novel features of the invention will be more fully understood from the following detailed description and the accompanying drawings, in which:

DETAILED DESCRIPTION OF THE INVENTION

Figure 1:
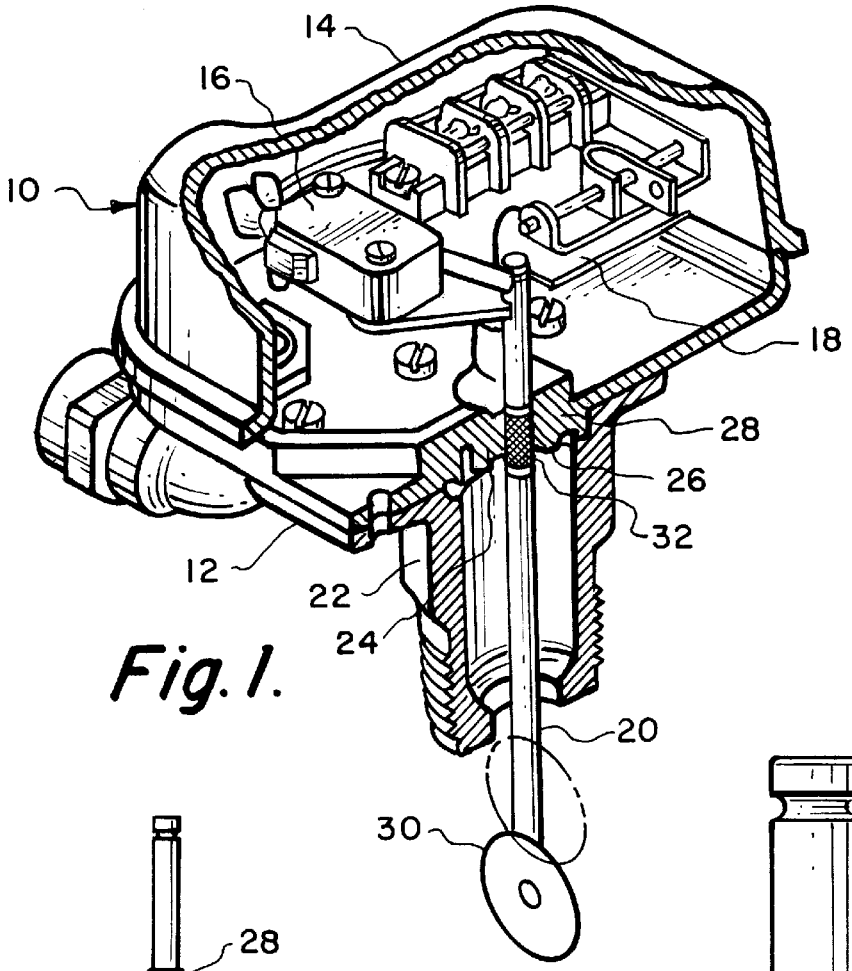
FIG. 1 is a perspective view of a flow switch having a pivot arm constructed according to the invention.
Figure 2:
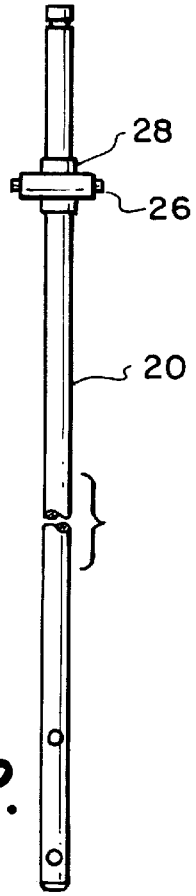
FIG. 2 is a side elevation of a pivot pin having a molded seal.

Referring now to FIG. 1, a fluid responsive switch 10 is shown having a housing 12 and sealed cover 14. Inside housing 12 is a microswitch 16 and adjustment spring 18 to adjust the force of a pivot arm 20 that is mounted to activate microswitch 16.

A switch body 22 is provided for attaching the fluid flow switch 10 to a fluid conduit (not shown) in the manner described in U.S. Pat. No. 4,074,097 issued Feb. 14, 1978 and incorporated herein by reference. Pivot arm 20 is mounted in a recess 24 in housing 12 by a pivot pin 26 and a resilient elastomer seal 28, molded around pivot arm 20 and pivot pin 26. Molded resilient seal 28 seals the inside of housing 12 from the fluid flowing in the pipe being monitored. Therefore, it is important that the integrity of resilient seal 28 be maintained. Resilient seal 28 must also be flexible enough to allow pivot arm 20 to pivot in its mounting by pivot pin 26. Pivot arm 20 is displaced by fluid flowing in a conduit, pushing on plate 30, attached to pivot arm 20.

As described hereinabove, the problem of providing a molded resilient seal around pivot arm 20, that can withstand peeling stresses, has often resulted in a high rejection rate of molded seals. Thus, to improve the integrity of molded resilient seal 28 around pivot arm 20 a cross-cut surface 32 is provided securely bond resilient seal 28 to pivot arm 20, as will be described in greater detail hereinafter.

The fluid responsive switch discussed above, and shown in FIG. 1 is a flow switch constructed to be mounted on a fluid conduit. However, the discussion above and hereinafter applies equally to a liquid level switch. The only difference is that the fluid responsive switch 10 would be mounted horizontal and a float would be mounted on pivot arm 20 instead of plate 30.

Figure 6:
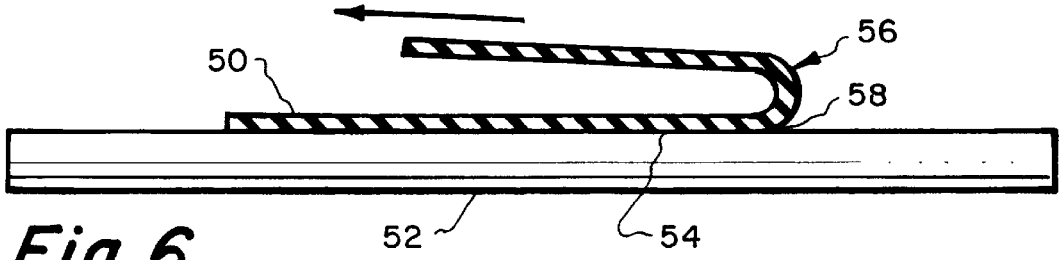
FIG. 6 is a diagram illustrating the peeling stresses on a pivot arm seal.

The simplified diagram of FIG. 6 illustrates a worst case idealized peeling action that causes problems when a resilient seal 50 is molded on a metal cylindrical shaft 52. Resilient seal 50 has a metal/elastomer interface bond indicated at 54 that presents a peeling angle indicated at 56 of about 180°. This produces maximum peeling stress indicated at 58 on metal/elastomer interface bond 54.

Figure 3:
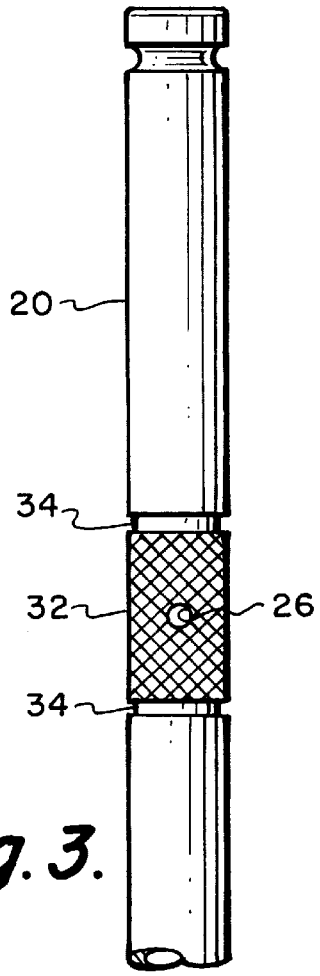
FIG. 3 is an enlarged view of a portion of the pivot pin of FIG. 2.

A pivot arm, constructed according to the invention that solves this problem, is illustrated in FIG. 3. Pivot arm 20 is provided with a mounting pin 26 traversed to the axis of the pivot arm, and a resilient molded seal 28 is bonded to pivot arm 20 and molded around pivot pin 26 as shown.

To improve the integrity of the seal between the material forming resilient seal 28 and the surface of pivot arm 20, the surface of pivot arm 20 is cross-cut as indicated at 32. The cross-cut surface is comprised of a plurality of cross-cut grooves diagonal to the axis of pivot arm 20. Preferably, the cross-cut grooves are in the range of ten to fifteen thousandths of an inch and extend an equal distance beyond the pivot pin 26 to provide a good resilient seal. Cross-cut surface 32 substantially improves the elastomer to metal bond for resilient materials such as Buna N, silicone, EDPM, Viton, etc. The resilient material, when molded around the cross-cut surface 32, flows into the "divots" around small islands formed by the cross-cut grooves. This significantly improves the integrity of the metal to elastomer or rubber interface bond, and substantially reduces the number of parts that are rejected for insufficient bonding.

To further improve the bonding, circumferential annular grooves 34 are added at each end of cross-cut surface 32. Preferably, these circumferential annular grooves are in the range of twenty to forty thousandths (0.020–0.040) of an inch deep, and approximately forty thousandths (0.040) of an inch wide; on pivot arm 20 it is approximately one-quarter of an inch in diameter. The elastomer material flows into circumferential grooves 34 further improving the integrity of the bond. With the resilient material flowing into circumferential annular grooves 34, the resistance to peeling tension parallel to the access along the outside surface of pivot arm 20, is substantially increased. Circumferential annular grooves 34 act as peeling stops resisting shear stress or peeling tension, replacing it with shear stresses.

In addition to reduced angle of strain on the elastomer, bonded to a smooth round rod as shown in FIG. 6, a force (F), will produce a localized surface square unit subject to a strain (S). This same force (F) applied to the multiple circumferential grooves plus the multiplicity of cross-cut diagonal grooves, forming small divots, increases the projected surface square unit of area by a factor of (P). Thus, the localized projected surface square unit strain (S) is reduced by a factor of e.g., $S_P=S/P$, where $S_P$ represents the cross-cut surface area and S represents a smooth surface area.

Figure 7:
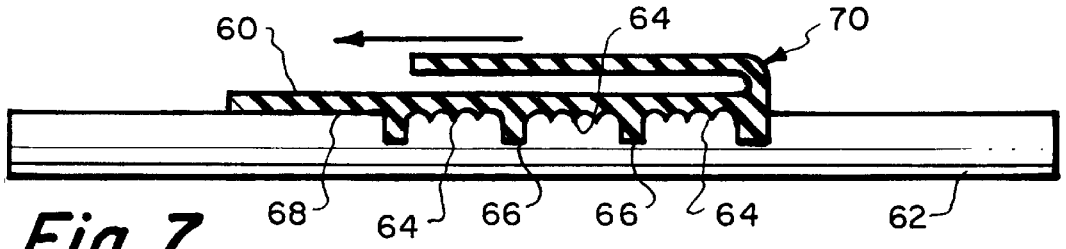
FIG. 7 is a diagram illustrating the effect of the improved pivot arm seal.
Figure 8A:
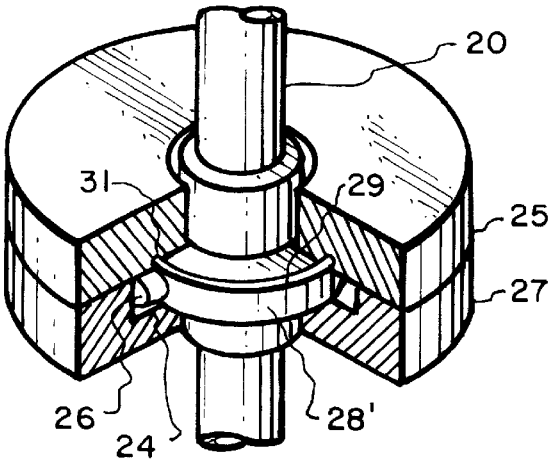
FIGS. 8, 8*a* and 8*b* illustrate another embodiment of the invention including an O-ring type seal.
Figure 8B:
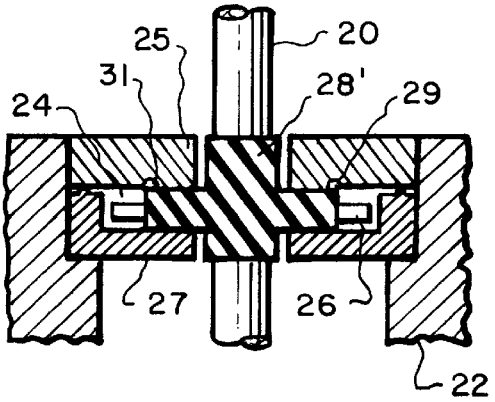
Figure 8:
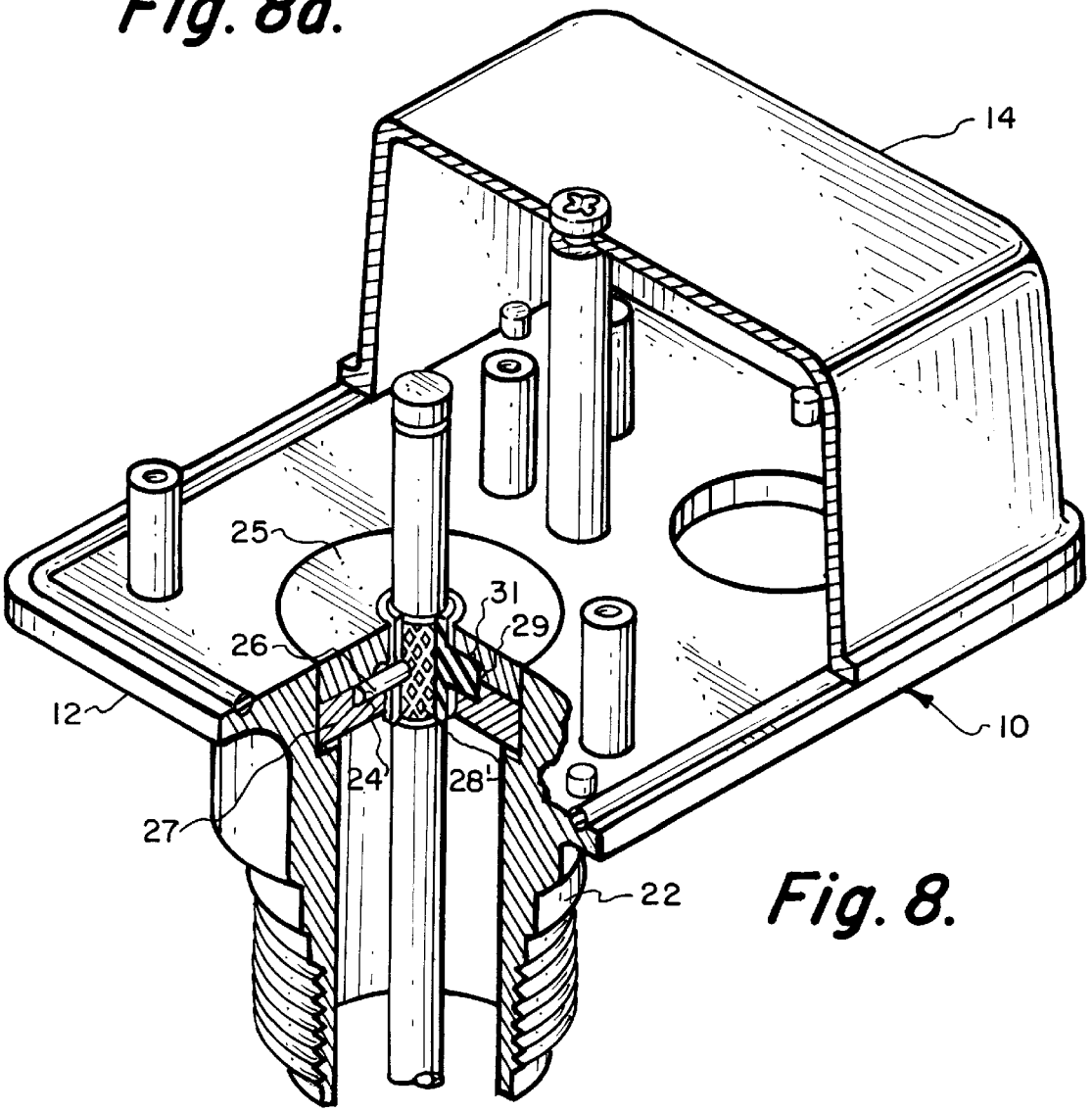

The improvement in the metal/elastomer interface bond is illustrated by the simplified block diagram of FIG. 7. For purposes of illustration, a resilient seal 60 is molded on a cylindrical shaft 62 having cross-cut surface 64 and a plurality of circumferential grooves 66 at the metal/elastomer interface bond. This changes the maximum peeling stress angle of about 180° indicated at 58 in FIG. 6 to about a 90° shear stresses indicated at 70 at a result of the circumferential grooves 66 and cross-cut surfaces 64. This spreads the shearing loads substantially improving the metal/elastomer bond, and improves the integrity of the molded resilient seal.

The preceding discussion is centered upon three special features to enhance the elastomer to metal bond, namely: 1) Reduce the elastomer/metal tension angle to a lessor value; 2) Break up the elastomer/metal interface into multiple series of circumferential annular grooves and cross-cut surface resulting in a multitude of islands and small divots, and; 3) increase interface surface bonding area. The unique improvements are centered upon the synergistic integration of these three features to provide a major increase in the elastomer to metal bond strength.

Figure 4:
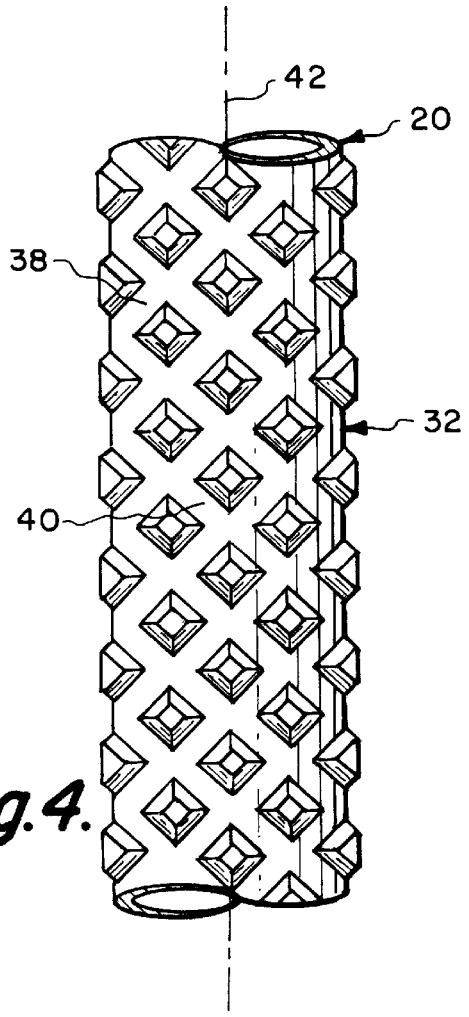
FIG. 4 is an enlarged view of the cross-cut area of pivot pin of FIG. 3.

The cross-cut diagonal grooves are shown in greater detail in the enlarged view of FIG. 4. As can be seen, the cross-cut surface is comprised of cross-cut grooves 38 and 40 in opposite directions, diagonal to the axis 42 of pivot arm 20. These grooves, on the order of ten thousandths of an inch, substantially improve the bonding of the elastomer such as Buna N, silicone, rubber, etc. to the surface of pivot arm 20 to maintain the integrity of the seal. Preferably, cross-cut grooves 38 and 40 are spaced to provide from ten to thirty grooves per inch. Of course, the depth, width and shape as well as the cross-cut angles, can be adjusted as needed according to the metal/elastomer surface interface loads. Further, grooves 38 can be spaced differently and cut deeper than grooves 40 if desired. Grooves 38 could be wider and deeper than grooves 40, and they could be spaced differently and at different angles if desired.

Figure 5:
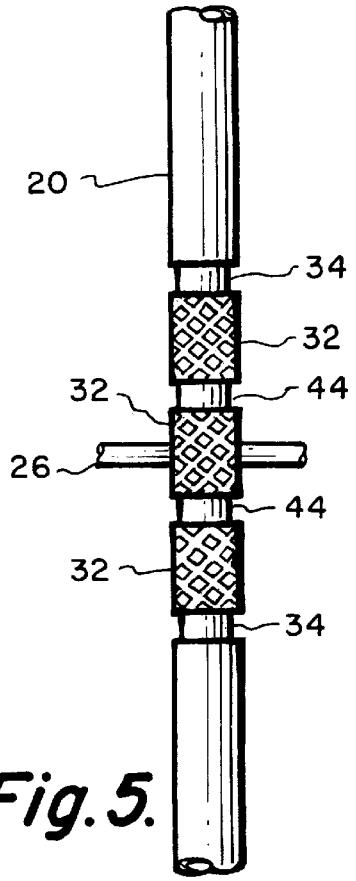
FIG. 5 illustrates an alternate embodiment of the pivot arm of FIG. 3.

An optional embodiment is shown in FIG. 5 in which three cross-cut surfaces 32 are provided surrounding pivot pin 26. Circumferential grooves 34 are provided at each end of the cross-cut surfaces as in the prior embodiment. To further improve the integrity of the bond, and provide additional stops to peeling tension and shear stress, additional circumferential annular grooves 44 provide intermediate circumferential annular grooves 34 at each end of cross-cut surfaces 32. This structure allows the resilient material forming seal 28 to flow, not only into the grooves of cross-cut surfaces 32, but also into the grooves 34 and 44, which act as peeling stops to prevent failure of the seal from peeling forces as the result of fluid flowing in a conduit.

Another optional, but preferred embodiment is shown in FIGS. 8 through 8*c* and 9 through 9*a*. In this embodiment, molded resilient seal 28' is provided around pivot arm 20 and pivot pin 26 as before. Resilient seal 28 is securely clamped in housing 12 with pivot seated in recess 24. Resilient seal 28' allows pivot arm 20 to pivot on pivot pin 26 while maintaining a fluid tight seal. The integration of pivot pin 26, resilient seal 28' and pivot arm 20 in housing 12 establishes and maintains a fixed rotational position of pivot arm 20 in relation to housing 12 which in turn maintains the fluid flow rotational direction relative to arm 20 while allowing sealed longitudinal angular motion of pivot arm 20 as described above.

To improve the sealing quality of resilient seal 28', a peripheral ridge or shoulder 29 similar to a half O-ring shape is integrally formed on the upper surface of resilient seal 28'. Peripheral semi-circular ridge 29 seats semi-circular in annulus 31 formed in mounting plate 25 above recess 24 in mounting plate 27 to provide additional sealing qualities to resilient seal 28'. Peripheral ridge 29 not only provides an efficient seal like an O-ring, it also securely locks seal 28' and pivot arm 20 in place in housing 12 between mounting plates 25 and 27.

Figure 9:
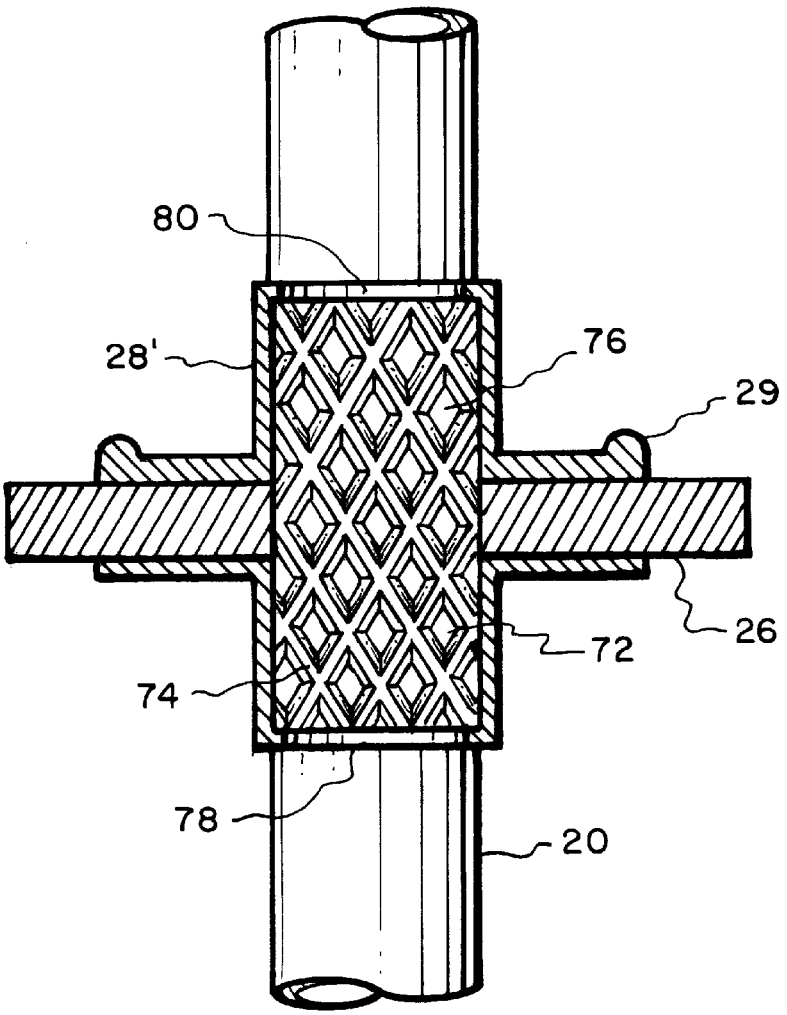
FIGS. 9 and 9*a* are enlarged partial sectional views illustrating the detail of the cross-cut surface and bonding of the seal.
Figure 9A:
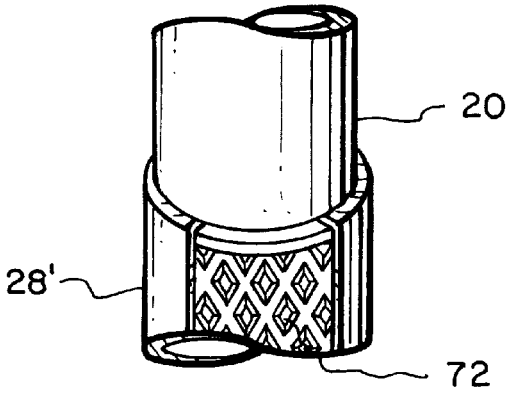

The formation of seal 28' around pivot arm 20 and pivot pin 26 is shown in more detail in FIGS. 9 and 9*a*. The construction shown in FIGS. 9 and 9*a* greatly improves the efficiency and integrity of resilient seal 28'.

Deep cross-cut surface 72 provides a series of deep and narrow grooves 74 and islands 76 that allow resilient material to flow into and around numerous deep narrow grooves to hold the seal 28' in place on pivot arm 20. Circumferential grooves 78 and 80 are provided at each end of deep cross-cut surface 72 and act as ripstop channels at each end of resilient seal 28'. Resilient seal 28' is terminated at the boundaries of upper and lower circumferential ripstop grooves or channels 78 and 80 so that there is no seal material beyond each end of cross-cut surface 72. By not allowing any seal material from extending beyond channels 78 and 80, a precisely formed circular ripstop channel of molded seal material reduces the elastomer/metal interface tensile load direction from 180° to 90° which in turn, doubles the interface bond strength.

As can be seen in FIG. 9*a,* resilient seal 28' fills circumferential channel and terminates there securely bonding the seal to pivot arm 20. The addition of the integrally formed O-ring seal by peripheral ridge 29 provides a dynamic, very durable seal for pivot arm 20 operating in a corrosive environment and sometimes under pressure.

Thus, there has been described, a fluid responsive switch having a pivot arm for monitoring fluid flow or liquid level with an improved resilient seal. The resilient seal is improved by providing a cross-cut surface to improve the bonding integrity of the elastomer material forming this seal to a pivoting arm mounted in the fluid responsive switch. The integrity of the bond can be further improved by providing circumferential annular grooves at each end of the cross-cut surface. A further improvement can be achieved by providing additional intermediate grooves in the cross-cut surface. Another optional but preferred feature is the formation of an integral O-ring seal on an upper surface of the seal. The integral O-ring seal is provided by a peripheral ridge molded into the upper surface of the seal that fits into an annulus in a mounting plate.

This invention is not to be limited by the embodiment shown in the drawings and described in the description which is given by way of example and not of limitation, but only in accordance with the scope of the appended claims.

What is claimed is:

1. In a fluid responsive switch having a housing containing a micro switch; a body attached to said housing for mounting said fluid responsive switch; a pivotally mounted metal arm having one end extending into said housing and the other end extending into a fluid; said end of said pivot arm extending into said fluid being displaced by fluid when the force of said fluid exceeds a certain amount; the improvement comprising;

a pivot pin traversing said pivot arm for pivotally mounting said pivot arm;

a molded resilient seal surrounding said pivot arm and pivot pin sealing said pivot arm at an entrance to said housing;

cross-cut grooves in a surface on said pivot arm to increase the surface area for securely bonding said resilient seal to the surface of said pivot arm;

a plurality of circumferential grooves in said pivot arm, one of said plurality of circumferential grooves being above said pivot pin and one below said pivot pin, said resilient seal flowing into said plurality of circumferential grooves;

a semi-circular peripheral ridge on an upper surface of said resilient seal providing an integrally formed dynamic O-ring type seal;

whereby said cross-cut surface, said plurality of circumferential grooves and said semi-circular peripheral ridge improve the integrity of the metal to elastic bond and prevent peeling at the edges providing an improved dynamic seal.

2. The fluid responsive switch according to claim 1 in which at least one of said circumferential grooves is at each end of said cross-cut surface and is substantially deeper than said cross-cut surface.

3. The fluid responsive switch according to claim 2 in which said plurality of circumferential grooves includes one or more intermediate circumferential grooves between said circumferential grooves at each end of said cross-cut surface.

4. The fluid responsive switch according to claim 1 wherein said cross-cut grooves in said pivot arm surface are cross-cut grooves in different directions providing a plurality of intersecting small diagonal grooves to break-up the surface being bonded into multiple small islands and divots acting as retention stops for said molded resilient seal.

5. The fluid responsive switch according to claim 4 in which said diagonal grooves have a depth in the range of 0.01 to 0.015 inches.

6. The fluid responsive switch according to claim 3 wherein said seal stops at upper and lower boundaries of said circumferential grooves.

7. The fluid responsive switch according to claim 6 wherein said cross-cut grooves are cut diagonal to the axis of said pivot arm.

8. The fluid responsive switch according to claim 7 in which said cross-cut grooves have a depth in the range of 0.01 and 0.015 inches.

* * * * *